US005274537A

United States Patent [19]

Altman

[11] Patent Number: 5,274,537

[45] Date of Patent: Dec. 28, 1993

[54] DECORATIVE LIGHTING ARRANGEMENT FOR SPECIAL EVENTS

[75] Inventor: Richard G. Altman, 10000 Old State Rd., Evansville, Ind. 47711

[73] Assignee: Richard G. Altman, Evansville, Ind.

[21] Appl. No.: 864,036

[22] Filed: Apr. 6, 1992

[51] Int. Cl.[5] ..... F21V 11/00

[52] U.S. Cl. ..... 362/353; 362/152

[58] Field of Search ..... 362/121, 122, 124, 353, 362/443, 806, 807, 808, 186, 152, 354, 439

[56] References Cited

U.S. PATENT DOCUMENTS 2,095,648 10/1937 Oftedahl ..... 362/121 X 2,714,652 8/1955 Meyer ..... 362/806 X

*Primary Examiner*—Stephen F. Husar

[57] ABSTRACT

A decorative lighting arrangement utilizing a standard commercial illuminated marker, such as one which outlines a walk, a driveway or the like. Importantly, the invention provides a substitute decorative component or structure which serves to replace the shade-cover typically found on the presently available marker. In other words, and through, for example, rotating action, the decorative component serves to present a holiday or special occasion motif through the use of and by modifying an existing light providing marker. The end effects of the invention are manyfold, serving to satisfy a variety of festive occasions.

4 Claims, 2 Drawing Sheets

DECORATIVE LIGHTING ARRANGEMENT FOR SPECIAL EVENTS

BACKGROUND OF THE INVENTION

As is known, it is customary to outline walks, driveways, or the like with illuminated markers, such typically being low to the ground and including a shade-cover for light diffusion. The preceding units come in various sizes, typically being placed through staking action, with an electrical cord passing between successive units and to a power source.

DESCRIPTION OF THE INVENTION

The invention takes the aforementioned type of commercially available marker and replaces the shade-cover and/or diffuser of such with a decorative member, such as of a type commonplace with a particular holiday or holiday season, e.g. Christmas, Halloween, Thanksgiving, and even such special events particular to the user, as, for example, a birthday.

Briefly, the prime or significant difference presented by the invention lies in the ornamental effect achieved by removing the usual shade-cover with a decorative component marking the occasion at hand.

Latching is accomplished in a manner similar to that presently available, i.e. through rotating action and cooperation between, for example, a detent with, for example, a receiving opening. The resulting ornamental marker is typically light in weight, made from a rigid weather resistant plastic resin, and susceptible to a myriad number of outward configurations.

DESCRIPTION OF THE FIGURES

In any event, a better understanding of the present invention will become more apparent from the following description, taken in conjunction with the accompanying drawing, wherein.

Figures 1, 2, 3:
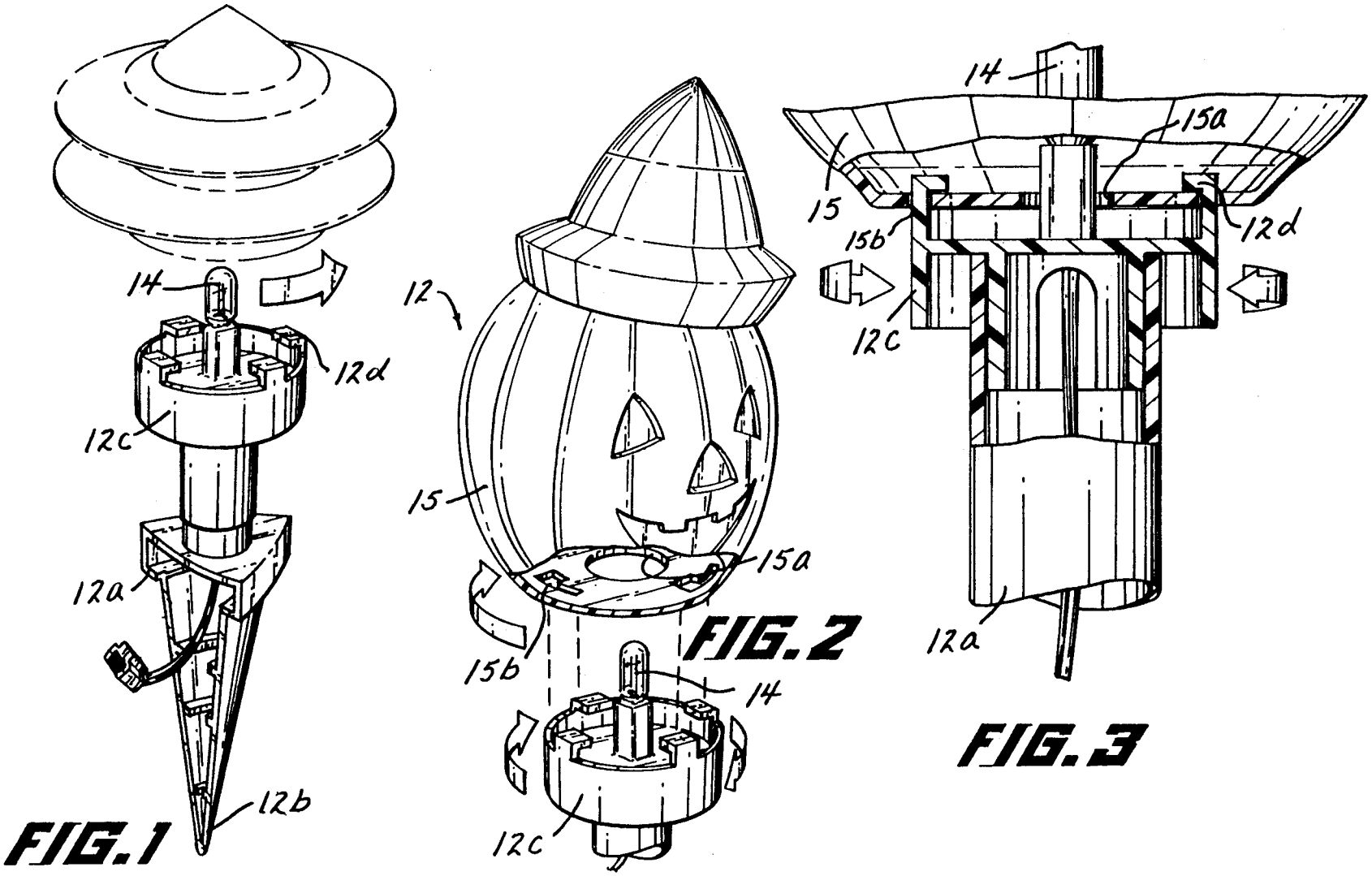
FIG. 1 is a perspective view, partly broken away, showing a conventional illuminated marker.
FIG. 2 is another perspective view, also in section, showing a modification made in accordance with the teachings of the present invention.
FIG. 3 is a view in side elevation, partly in vertical section, showing a form of latching device as used in the structures of FIGS. 1 and 2.

For the purposes of promoting and understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

DESCRIPTION OF THE PREFERRED EMBODIMENTS

Referring now to the figures, and particularly FIGS. 1 to 3, inclusive, one form of lighting arrangement 12 in accordance with the teachings of the invention includes a base section 12*a* tapering to a point 12*b* for easy insertion into the ground at a desired location. The base section 12*a* includes a upper portion 12*c* which mounts a light bulb 14 and includes inwardly projecting tabs 12*d* which serve as part of a latching arrangement.

FIG. 2 details the invention after removal of the usual shade-cover (shown in phantom in FIG. 1) and replaced by an ornamental or decorative component 15 showing the desired holiday motif, i.e. in this instance a Jack-O-Lantern. The base of the aforesaid decorative component 15 includes an opening 15*a* for receiving light bulb 14, as well as cut-outs 15*b* which cooperate with the inwardly projecting tabs 12*d*.

FIG. 3 details the bottom of the ornamental component 15 mounted on the base section 12*a*, where assembly is accomplished by rotation in the direction of the arrows. In other words, an ordinary illuminated shade-cover is replaced to signify a "special" occasion.

Figure 6:
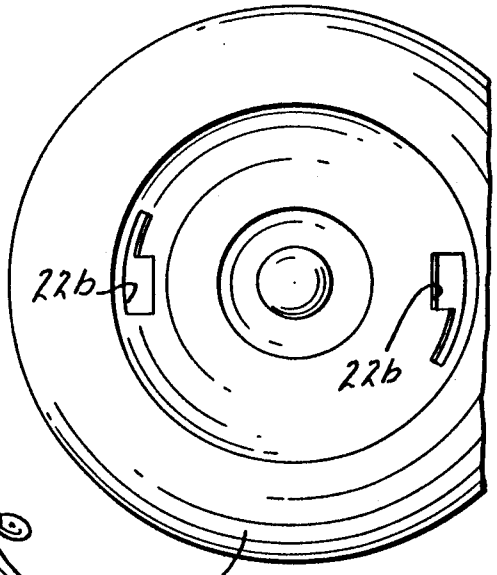
Figure 5:
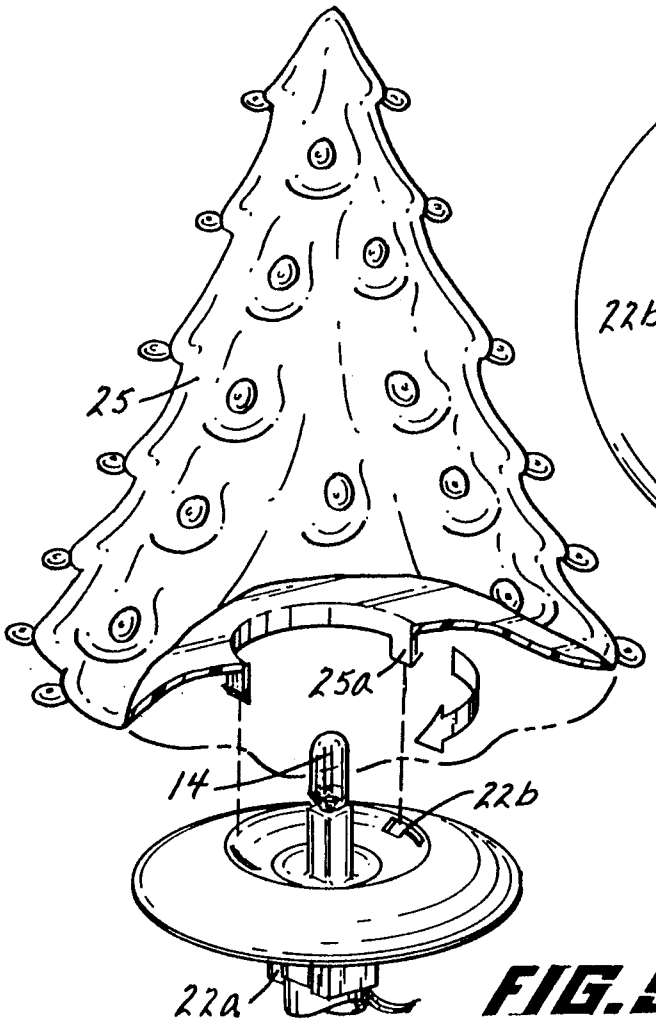
FIG. 5 is still another perspective view, partly in vertical section, showing the marker of FIG. 4 modified in accordance with the teachings of the present invention; and, FIG. 6 is a top plan view showing a typical latching arrangement prior to installing a substitute decorative structure.
Figure 4:
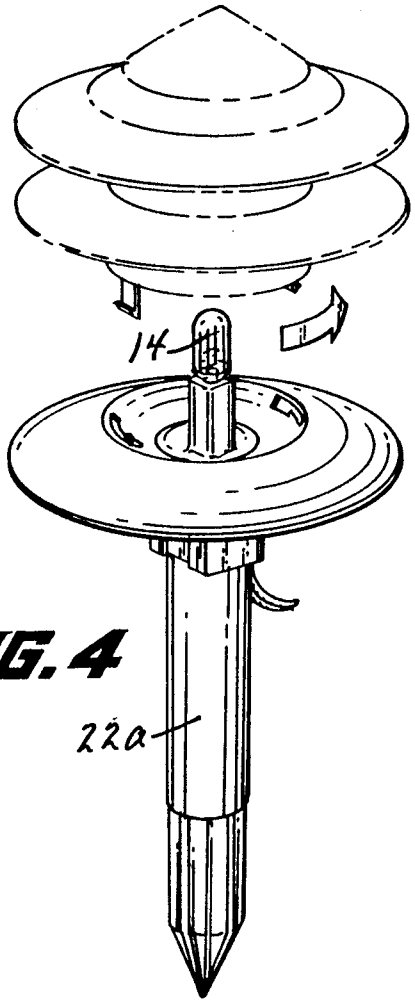
FIG. 4 is a perspective view of another form of illuminated marker presently available to the consumer.

Looking now at FIGS. 4 to 6, inclusive, another form of base section 22*a* is disclosed, including, a latching assembly, a light bulb 14 and a shade-cover (shown in phantom in FIG. 4). As in the other disclosed arrangement, decorative component 25 is modified along the bottom thereof and latching is accomplished through the modified keyhole openings 22*b* and cooperating outwardly extending tabs 25*a*. FIG. 6 closely demonstrates a particular latching arrangement, where, again, assembly of the ornamental/decorative component 25 is accomplished through rotating action with respect to the base section 22*a*.

As should be evident, the invention replaces a rather mundane lighting fixture to a cheerful holiday presentation, all being with little effort on the part of the user, i.e. by substituting an ornamental component for the generally standardized shade-cover. Many holidays can be emphasized and a festive mood implemented. Depending upon the original fixture, ready rotation of the decorative arrangement (on the base section) can oftentimes be accomplished for special effects.

The illustrated decorative lighting arrangement described hereabove is susceptible to various changes within the spirit of the invention, including, by way of example, in proportioning; the type of display employed; the manner of latching and/or assembly; and, the like. Thus, the preceding should be considered illustrative and not as limiting the scope of the following claims.

I claim:

1. A decorative lighting arrangement for an illuminated marker including a removable shade-cover and a base adapted to be mounted on a support surface comprising a decorative component substituted for said removable shade-cover, and means selectively latching said decorative component onto said base.

2. The decorative lighting arrangement of claim 1 where latching is accomplished by rotating action.

3. The decorative lighting arrangement of claim 1 where said decorative component is representative of various holiday occasions.

4. The decorative lighting arrangement of claim 1 where said decorative component presents a base rotatably positioned at the location of said original removable shade-cover, and where said decorative component is selectively directionally oriented on said base.

* * * * *